US009768541B1

(12) United States Patent
Eiden et al.

(10) Patent No.: US 9,768,541 B1
(45) Date of Patent: Sep. 19, 2017

(54) PLUG RECEPTACLE FOR AN ELECTRONIC DEVICE

(71) Applicant: Microsoft Technology Licensing, LLC, Redmond, WA (US)

(72) Inventors: Niko Eiden, Espoo (FI); Ville Vehkaperä, Oulu (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/233,841

(22) Filed: Aug. 10, 2016

(51) Int. Cl.
*H01R 13/453* (2006.01)
*H01R 24/58* (2011.01)
*H01R 107/00* (2006.01)

(52) U.S. Cl.
CPC ..... *H01R 13/453* (2013.01); *H01R 24/58* (2013.01); *H01R 2107/00* (2013.01)

(58) Field of Classification Search
CPC .... H01R 2107/00; H01R 24/60; H01R 12/58; H01R 13/447; H01R 13/453; H01R 13/639; H01R 12/774
USPC ..... 439/137, 136, 147, 668
See application file for complete search history.

(56) References Cited

U.S. PATENT DOCUMENTS 3,659,248 A * 4/1972 Mann ..... H01R 13/447 439/144
4,659,167 A * 4/1987 Masuda ..... H01H 11/00 439/668
4,937,404 A * 6/1990 Kitagawa ..... H01R 13/7035 200/51.09
7,997,911 B2 * 8/2011 Wang ..... G06F 1/1616 361/679.43
8,123,569 B2 * 2/2012 Little ..... H01R 13/52 439/669
8,348,684 B2 * 1/2013 Ladouceur ..... H04M 1/0274 439/131
8,353,729 B2 1/2013 Dabov et al.
8,449,311 B2 5/2013 Montena
(Continued)

FOREIGN PATENT DOCUMENTS

CN 201639618 U 11/2010
CN 202602742 U 12/2012
(Continued)

OTHER PUBLICATIONS

Linder, Brad, "Asus 1015E review: 10 inch notebook with a Celeron 847 CPU", Published on: May 18, 2013, 25 pages, Available at: http://liliputing.com/2013/05/asus-1015e-low-cost-mini-notebook-review.html.

*Primary Examiner* — Tulsidas C Patel
*Assistant Examiner* — Travis Chambers

(57) ABSTRACT

A plug receptacle comprises a receptacle housing having a passage configured to receive at least a part of a plug of a plug connector, a front side having a first opening and a top side having a second, elongated opening that intersects the first opening, the passage opening to the front side via the first opening and to the top side via the second opening. The plug receptacle comprises at least one plug receptacle cover that is configured to move between a cover position and an elevated position. In the cover position, the at least one plug receptacle cover covers the second opening at least partially. In the elevated position, the at least one plug receptacle cover is elevated outwards along its entire length, so that the at least the part of the plug partially extends through the second opening.

20 Claims, 5 Drawing Sheets

(56) References Cited

U.S. PATENT DOCUMENTS

| | | | | |
|---|---|---|---|---|
| 8,758,032 | B2 * | 6/2014 | Liang | H01R 13/447 439/131 |
| 9,356,408 | B1 * | 5/2016 | Biddle | H01R 24/76 |
| 2004/0203515 | A1 | 10/2004 | Kuriyama | |
| 2011/0013372 | A1 * | 1/2011 | Kang | G06F 1/1656 361/752 |
| 2011/0076896 | A1 * | 3/2011 | Jol | H01R 13/187 439/668 |
| 2013/0078869 | A1 | 3/2013 | Golko et al. | |
| 2013/0137283 | A1 * | 5/2013 | Lin | H01R 13/518 439/140 |
| 2013/0244491 | A1 | 9/2013 | Sarwar et al. | |
| 2014/0134859 | A1 | 5/2014 | Lee et al. | |

FOREIGN PATENT DOCUMENTS

| | | |
|---|---|---|
| CN | 203398401 U | 1/2014 |
| CN | 203423304 U | 2/2014 |

* cited by examiner

PLUG RECEPTACLE FOR AN ELECTRONIC DEVICE

BACKGROUND

Many electronic devices such as mobile phones, MP3 players and various portable audio devices may require or allow the use of external audio earphones, headphones or a head set in order to play media sound. A microphone may be required in order to talk to a caller on a mobile phone when, for example, a head set is connected to the mobile phone.

Standard connectors may be available with standard sizes. Standard audio connectors or plugs are popular in three sizes based on the outside diameter of the plug: 6.35 mm, 3.5 mm and 2.5 mm plugs. Standard receptacles for such connectors may include an opening having an interior diameter sized so that it can receive and engage the plug and may, for example, therefore exceed 3.5-4 mm for a 3.5 mm audio connector.

For thin electronic devices, the thickness of such a standard receptacle may be challenging to accommodate. The standard receptacle may be thicker than the electronic device, or the standard receptacle may take up so much space within the electronic device that it may be more challenging to fit internal components such as a display, electronics, a battery etc. inside the electronic device.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A plug receptacle is disclosed. The plug receptacle may comprise a receptacle housing having a passage configured to receive at least a part of a plug of a plug connector, a front side having a first opening and a top side having a second, elongated opening that intersects the first opening, the passage opening to the front side via the first opening and to the top side via the second opening. The plug receptacle may further comprise at least one plug receptacle cover that is configured to move between a cover position and an elevated position, wherein in the cover position, the at least one plug receptacle cover covers the second opening at least partially; and in the elevated position, the at least one plug receptacle cover is elevated outwards, the plug receptacle thereby being configured to receive the at least the part of the plug so that the at least the part of the plug partially extends through the second opening.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein:

In FIGS. 1 to 8, the plug receptacles and electronic devices are illustrated as schematic drawings. The drawings may not be to scale.

DETAILED DESCRIPTION

The detailed description provided below in connection with the appended drawings is intended as a description of a number of embodiments and is not intended to represent the only forms in which the embodiments may be constructed, implemented, or utilized.

Figure 1A:
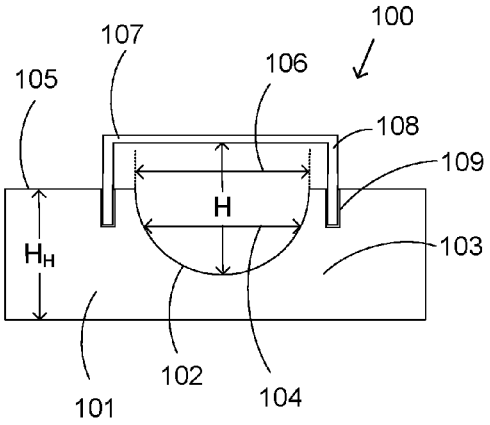
FIGS. 1A and 1B illustrate cross-sectional views and details of an embodiment of a plug receptacle.

The plug receptacle 100 of FIG. 1A is shown as a cross-sectional view. The plug receptacle 100 comprises a receptacle housing 101 having a passage 102, which is configured to receive and engage at least a part of a plug 111 of a plug connector 110; the plug connector 110 is, however, not shown in FIG. 1A. The passage 102 may be, but is not necessarily longitudinal. In this cross-sectional view, the passage 102 has an arcuate or semi-circular cross-section to fit against the circular plug 111. However, the cross-section of the passage 102 is not particularly limited to being arcuate, partially circular or semi-circular in shape, but may be e.g. rectangular. The receptacle housing 101 has a front side 103 having a first opening 104. The passage 102 opens to the front side 103 via the first opening 104 so that when in use, the at least the part of the plug 111, i.e. a part of the plug or the entire plug, may be inserted into the passage 102 through the first opening 104. The receptacle housing 101 further has a top side 105 having a second opening 106. The passage 102 opens to the top side 105 via the second opening 106. The top side 105 is adjacent to the front side 103. Although it cannot be directly seen in FIG. 1A, the second opening 106 is elongated. In this embodiment, the second opening 106 extends perpendicularly into the passage 102. The first opening 104 and the second opening 106 intersect to form a continuous opening via which the passage 102 opens to the top side 105 and to the front side 103.

It should be understood that terms such as "front side", "top side", "bottom side", "top", "bottom", "side" and "below" are merely for ease of description and not intended to indicate the orientation of the sides in which they are specifically configured to be when in use. When in use, the front side and the top side may be disposed upward, downward, frontward or backward.

The plug receptacle 100 further comprises a plug receptacle cover 107. The plug receptacle cover 107 is configured to move between a cover position and an elevated position. In this embodiment, the plug receptacle cover 107 is configured to slide between a cover position and an elevated position. In this exemplary embodiment, the plug receptacle cover 107 comprises a cover portion having a top side 113 and support portions 108. The receptacle housing 101 comprises guide structures 109 configured to guide the movement of the plug receptacle cover 107 between the cover position and the elevated position. The support portions 108 are configured to move, for instance slide, with respect to the guide structures 109. In this exemplary embodiment, the guide structures 109 are recesses extending into the receptacle housing 101 and opening to the top side 105. The support portions 108 extend within the guide structures 109 and are configured to move within them. The support portions 108 also connect the plug receptacle cover 107 to the receptacle housing 101. In FIG. 1A, the plug receptacle cover 107 is shown in the cover position. In the cover position, the plug receptacle cover 107 covers the second opening 106 at least partially. The plug receptacle cover 107 and the passage 102 define a space having a height H in the cover position. The plug receptacle cover 107 and the passage 102 define, in the cover position, a space having a height H smaller than the height of the at least the part of the plug 111 or, in this exemplary case of a plug having a circular cross-section, smaller than the diameter D (outer or cross-sectional diameter) of the at least the part of the plug 111 shown in FIG. 1B.

Figure 1B:
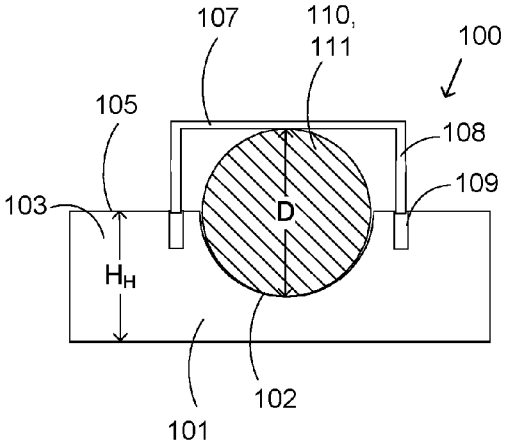

FIG. 1B illustrates the plug receptacle 100 of FIG. 1A in an elevated position. In the elevated position, at least a part of a plug 111 of a plug connector 110 is disposed in the plug receptacle 100. The term "plug" may be understood as referring to the male electric contact portion of a plug connector; a plug connector may comprise, in addition to the plug itself, other components such as a shell for gripping the plug connector. Upon being inserted into the plug receptacle 100, the at least the part of the plug 111 forces the plug receptacle cover 107 to move and thereby be elevated outwards, i.e. away from the passage and relative to the cover position. In an embodiment, the plug receptacle cover is configured to slide between the cover position and the elevated position, i.e. it may slide outwards to the elevated position and inwards to the cover position. In this embodiment, the plug receptacle cover 107 is elevated outwards along its entire width. In an embodiment, the entire plug receptacle cover 107 is elevated relative to the cover position. The plug receptacle cover 107 in the cover position defines a reference level, relative to which the plug receptacle cover 107 is elevated in the elevated position.

The plug receptacle cover 107 and the passage 102 define, in the elevated position, a space having a height greater than the height H in the cover position; this height in the elevated position may be equal to or greater than the diameter D of the at least the part of the plug 111. The plug receptacle cover 107 is thus configured to receive the at least the part of the plug 111. The plug receptacle cover 107 may return or revert to the cover position upon removal of the at least the part of the plug 111. The plug receptacle cover 107 may thus be considered to be a pop-up cover for the plug receptacle 100.

In the elevated position, at least a part of the plug 111 received may extend through the second opening 106, i.e. beyond the top side 105 of the receptacle housing 101. The width of the first opening 104 and the width of the passage 102 may be equal to or greater than the diameter D of the at least the part of the plug 111.

In an embodiment, the height $H_H$ of the receptacle housing 101 is smaller than the height of the at least the part of the plug 111. In an embodiment in which the at least the part of the plug 111 has a circular cross-section, the height of the at least the part of the plug 111 corresponds to its diameter D, so that the height $H_H$ of the receptacle housing 101 may be smaller than the diameter D of the at least the part of the plug 111.

The plug receptacle cover 107 may be inelastic and/or rigid, as opposed to being elastic and/or bendable. It may also be non-extendable. The material of the plug receptacle cover 107 is not particularly limited; examples of suitable materials may be e.g. plastics and ceramics. The material of the plug receptacle cover 107 may be non-conductive, in particular the parts of the plug receptacle cover 107 that are configured to be in contact with the at least the part of the plug 111. Alternatively, the plug receptacle cover 107 may comprise or be mainly formed of a conductive material, such as an alloy or composite metal, provided that the parts of the plug receptacle cover 107 that are configured to be in contact with the at least the part of the plug 111 are coated or covered with a layer of non-conductive material.

In an embodiment, the plug receptacle cover 107 is configured to exert a force against the at least the part of the plug 111 in the elevated position, thereby engaging the at least the part of the plug 111. The thickness of the plug receptacle cover 107 may be approximately 1 mm or less, but it may also be smaller or greater.

In an embodiment, the plug receptacle 100 is an audio plug receptacle. In an embodiment, the audio plug receptacle is configured to receive and engage at least a part of an audio plug having a circular cross-section. In an embodiment, the plug receptacle 100 is an audio plug receptacle configured to receive at least a part of the plug of a standard 2.5 mm (3/32"), or 3.5 mm (1/8"), or 6.35 mm (1/4") audio plug connector. Such connectors are also referred to as audio jacks or jack plugs. The plug receptacle 100 may thus be referred to as a socket or jack socket.

The plug receptacle 100 may further comprise one or more electric contacts (not shown in FIGS. 1A and 1B). The one or more electric contacts, for example a plurality of electric contacts, may be disposed within the passage 102.

Figure 2A:
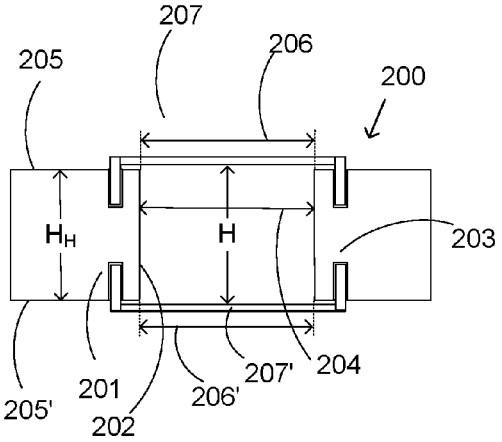
FIGS. 2A and 2B illustrate cross-sectional views and details of an embodiment of a plug receptacle.
Figure 2B:
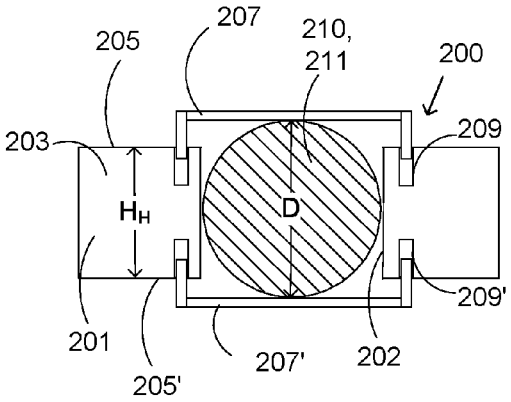

The plug receptacle 200 of FIGS. 2A and 2B differs from that of FIGS. 1A and 1B at least in that the receptacle housing 201 has a bottom side 205' having a third opening 206'. The bottom side 205' is a side opposite to the top side 205. The passage 202, which is configured to receive and engage at least a part of a plug 211 of a plug connector 210, opens to the bottom side 205' via the third opening 206'. In this cross-sectional view of this exemplary embodiment, the passage 202 has a rectangular cross-section. In other embodiments, the passage 202 may have e.g. an arcuate or partially circular cross-section to fit against the at least the part of the circular plug 211. However, other shapes for the cross-section of the passage 202 may also be contemplated. The receptacle housing 201 has a front side 203 having a first opening 204. The passage 202 opens to the front side 203 via the first opening 204 so that when in use, the at least the part of the plug 211 may be inserted into the passage 202 through the first opening 204. The receptacle housing 201 further has a top side 205 having a second opening 206. The passage 202 opens to the top side 205 via the second opening 206. Although not directly visible in FIG. 2A, the second opening 206 and the third opening 206' are elongated. In this embodiment, the second opening 206 and the third opening 206' extend perpendicularly into the passage 202. The first opening 204, the second opening 206 and the third opening 206' intersect to form a continuous opening, via which the passage 202 opens to the front side 203, the top side 205 and the bottom side 205'. In an embodiment, the third opening 206' has a width equal to the width of the second opening 206. In an embodiment, the third opening 206' has a length equal to the length of the second opening 206.

Figure 3A:
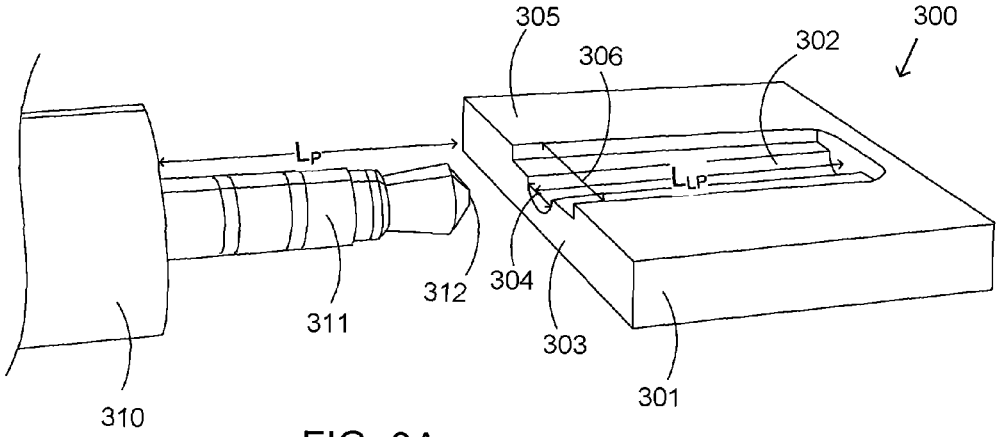
FIGS. 3A and 3B illustrate alternative perspective views and details of an embodiment of a plug receptacle.

The plug receptacle 200 further comprises a first plug receptacle cover 207 at the top side 205 of the receptacle housing 201 and a second plug receptacle cover 207' at the bottom side 205' of the receptacle housing 201. In this exemplary embodiment, the entire first and second plug receptacle cover 207, 207' may be configured to move between a cover position and an elevated position. In an embodiment, the first and second plug receptacle cover 207, 207' are configured to move simultaneously between a cover position and an elevated position. In FIG. 3A, both plug receptacle covers 307, 307' are shown in the cover position covering the second opening 206 and the third opening 206', respectively.

In the cover position, the first and second plug receptacle covers 207, 207' cover the second opening 206 and the third opening 206', respectively, at least partially. The plug receptacle covers 207, 207' and the passage 202 define a space having a height H in the cover position. The receptacle housing 201 comprises guide structures 209, 209' configured to guide the movement of the plug receptacle covers 207, 207' between the cover position and the elevated position.

FIG. 2B illustrates the plug receptacle 200 of FIG. 2A in an elevated position, according to an embodiment. In the elevated position, a plug 211 of a plug connector 210 is disposed in the plug receptacle 200. The plug receptacle covers 207, 207' and the passage 202 define a space having a height that is greater than the height H in the cover position and equal to or greater than the height of the at least the part of the plug 211 or, in this exemplary case of a plug having a circular cross-section, smaller than the diameter D of the at least the part of the plug 211. Upon being inserted into the plug receptacle 200, the at least the part of the plug 211 forces the first and second plug receptacle cover 207, 207' to move outwards and to the elevated position. The plug receptacle cover 200 is thus configured to receive the at least the part of the plug 211. In the elevated position, at least a part of the inserted plug 211 extends through the second opening 206, i.e. beyond the top side 205 of the receptacle housing 201, and through the third opening 206', i.e. beyond the bottom side 205' of the receptacle housing 201.

In an embodiment, the height $H_H$ of the receptacle housing 201 is smaller than the height of the at least the part of the plug 211. In an embodiment in which the at least the part of the plug has a circular cross-section, the height of the at least the part of the plug 211 corresponds to its diameter D, so that the height $H_H$ of the receptacle housing 201 is smaller than the diameter D of the at least the part of the plug 211.

Other aspects of the embodiment shown in FIGS. 2A and 2B are generally similar to those of the embodiment shown in FIGS. 1A and 2B.

Figure 3B:
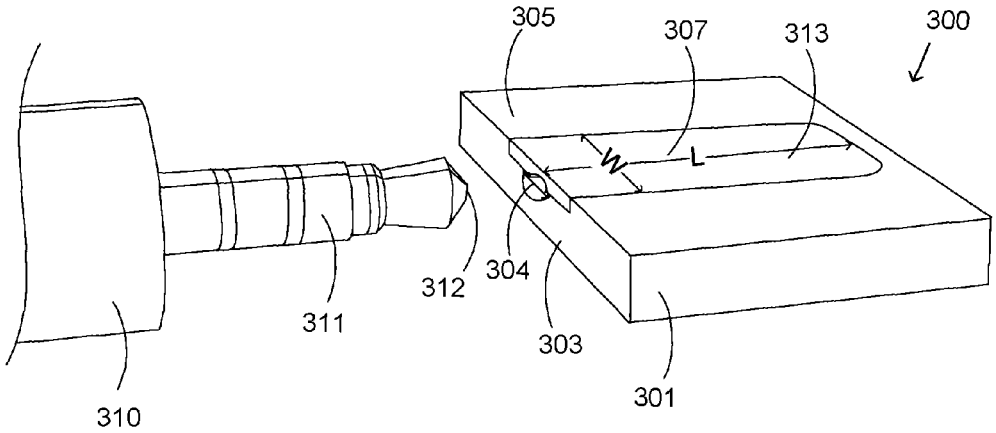

FIGS. 3A and 3B illustrate an exemplary embodiment of a plug receptacle 300 configured to receive at least a part of the plug 311 of a plug connector 310, in this embodiment a standard 2.5 mm or 3.5 mm audio connector. The plug 311 has a length $L_P$, which for a standard 2.5 mm audio connector may be 11 mm and for a standard 3.5 mm audio connector 14 mm. The plug 311 also has a flat portion 312 at the tip, the flat portion 312 being perpendicular to the longitudinal axis of the plug 311. The plug receptacle 300 is illustrated in FIG. 3A without the plug receptacle cover 307 and in FIG. 3B with the plug receptacle cover 307. In FIG. 3A, the receptacle housing 301 has a longitudinal passage 302, which is configured to receive and engage the at least the part of the plug 311. The longitudinal passage 302 may be longitudinally disposed within the receptacle housing 301. The receptacle housing 301 has a front side 303 having a first opening 304, via which the longitudinal passage 302 opens to the front side 303. The receptacle housing 301 further has a top side 305 having a second elongated opening 306, via which the longitudinal passage 302 opens to the top side 305. The longitudinal passage 302 has a length $L_{LP}$ in the direction of the longitudinal axis of the plug 311, i.e. in the direction of the length $L_P$ of the plug 311 when the at least a part of the plug 311 is received in the plug receptacle 300. In this embodiment, the length of the elongated second opening 306 is also equal to the length $L_{LP}$ of the longitudinal passage 302. The length $L_{LP}$ may be equal to or substantially equal to the length $L_P$ of the plug 311. It may also be smaller or greater than $L_P$.

In FIG. 3B, the plug receptacle cover 307 is in the cover position, and thus covers the second opening 306 which cannot be clearly seen in this FIG. The plug receptacle cover 307 is recessed in the receptacle housing 301. In this embodiment, the plug receptacle cover 307 lies within the second opening 306 in the cover position. In an embodiment, the plug receptacle cover 307 lies within the longitudinal passage 302 in the cover position. In this embodiment, the plug receptacle cover 307 has a top side 313, which has a planar surface. The top side 313 of the plug receptacle cover 307 is flush with the top side 305 of the receptacle housing 301 in the cover position. In other words, the top surface of the top side 313 of the plug receptacle cover 307 is flush with the top surface of the top side 305 of the receptacle housing 301, i.e. the surface of the top side 313 of the plug receptacle cover 307 lies at the level defined by the surface of the top side 305 of the receptacle housing 301. In such an embodiment, the top side 313 of the plug receptacle cover 307 and the top side 305 of the receptacle housing 301 may feel seamless in the cover position. However, in other embodiments, the top side 313 of the plug receptacle cover 307 may also be recessed within the top side 305 of the receptacle housing 301, i.e. the surface of the top side 313 may be below the level of the top side 305 of the receptacle housing 301. In other embodiments, it may protrude or slightly protrude outwards from the top side 305 of the receptacle housing 301.

The size and shape of the plug receptacle cover 307 is not particularly limited. They may be selected depending on the type and size of plug it is intended to cover, on the size of the plug receptacle 300 and/or the size of an electronic device comprising the plug receptacle 300, or other considerations. The color of the plug receptacle cover 307, its material and/or other properties may be selected so that the plug receptacle cover 307 blends well in with the receptacle housing 301.

The first opening 304 and the second opening 306 intersect to form a continuous opening, to which the longitudinal passage 302 opens. When in use, the at least the part of the plug 311 may be inserted into the longitudinal passage 302 through the first opening 304. In this embodiment, the bottom of the longitudinal passage 302 has an arcuate or semi-circular cross-section, and the first opening 304 has a width that is greater than the width of the flat portion 312 at the tip of the plug 311. Thus the tip of the at least the part of the plug 311 can be inserted into the first opening 304 so that it slides into the longitudinal passage 302 below the plug receptacle cover 307, thereby forcing the plug receptacle cover 307 to move outwards and into the elevated position. The first opening 304 and the space defined by the plug receptacle cover 307 and the longitudinal passage 302 thus function as a plug ramp for sliding the at least the part of the plug 311 underneath the plug receptacle cover 307. The height of the space defined by the plug receptacle cover 307 and the longitudinal passage 302 may be, for example, up to 3.5 mm, or up to 2 mm, or 1 to 2 mm. The height of the space defined by the plug receptacle cover 307 and the longitudinal passage 302 may also be higher than the height of the flat portion 312 at the tip of the plug 311.

In an embodiment, the plug receptacle 300 comprises an elevating arrangement configured to move the plug receptacle cover 307 between the cover position and the elevated position. Such an elevating arrangement may comprise e.g. an electrical or electromechanical actuator configured to move the plug receptacle cover 307 between the cover position and the elevated position, in particular to move the plug receptacle cover 307 outwards to the elevated position. Such an elevating arrangement may be controlled e.g. by software or by a switch. In such an embodiment, the plug receptacle cover 307 does not have to be forced outwards by the at least the part of the plug 311 itself, and thus the first opening 304 does not necessarily have to be visible for the user when the plug receptacle cover 307 is in the cover position.

The plug receptacle cover 307 has a length L and a width W. The plug receptacle cover 307 may be elevated, in the elevated position, along its entire length L and width W relative to the cover position. In an embodiment, the length L of the plug receptacle cover 307 is equal to the length of the longitudinal passage 302. The length L of the plug receptacle cover 307 is parallel to the length (longitudinal axis) of the plug the at least the part of which the plug receptacle 300 is configured to receive. The width W of the plug receptacle cover 307 is perpendicular to the length L.

Other aspects of the embodiment shown in FIGS. 3A and 3B are generally similar to those of the embodiment shown in FIGS. 1A to 2B.

Figure 4:
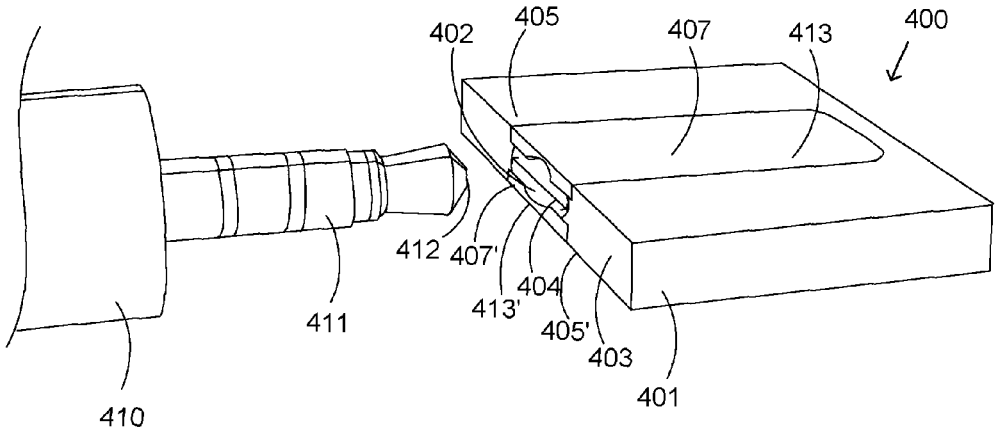
FIG. 4 illustrates a perspective views and details of an embodiment of a plug receptacle.

The plug receptacle 400 of FIG. 4 differs from that of FIGS. 3A and 3B at least in that the receptacle housing 401 has a bottom side 405' having a third opening, which however cannot be clearly seen in this FIG. The longitudinal passage 402 opens to the bottom side 405' via the third opening. The longitudinal passage 402 is configured to receive and engage at least a part of the plug 411 of a plug connector 410. In this exemplary embodiment, the longitudinal passage 402 has a partially circular cross-section. In other embodiments, the longitudinal passage 402 may have e.g. an arcuate or rectangular cross-section. However, other shapes for the cross-section of the longitudinal passage 402 may also be contemplated.

The plug receptacle 400 in this embodiment comprises a first plug receptacle cover 407 at the top side 405 and a second plug receptacle cover 407' at the bottom side 405'. In this exemplary embodiment, the entire first and second plug receptacle covers 407, 407' may be configured to move between a cover position and an elevated position. In an embodiment, the first and second plug receptacle cover 407, 407' are simultaneously movable between a cover position and an elevated position. In FIG. 4, both plug receptacle covers 407, 407' are shown in the cover position.

In the cover position, the first and second plug receptacle covers 407, 407' cover the second opening 406 and the third opening 406' of the receptacle housing 401, respectively, at least partially. In this embodiment, the first plug receptacle cover 407 has a top side 413, and the top side 413 of the plug receptacle cover 407 is flush with the top side 405 of the receptacle housing 401 in the cover position. The second plug receptacle cover 407' has a bottom side 413' which may likewise be flush with the bottom side 405' of the receptacle housing 401.

Upon being inserted into the plug receptacle 400, the at least the part of the plug 411 may force the reversibly extendable first and second plug receptacle covers 407, 407' to move outwards, i.e. away from the longitudinal passage, and to the elevated position. The plug receptacle cover 400 is thus configured to receive the at least the part of the plug 411. This exemplary embodiment is thus similar to that shown in FIGS. 3A and 3B. In embodiments such as the embodiment shown in FIG. 4, the receptacle housing 401 may be very thin, for example card-like. Other aspects of the embodiment shown in FIG. 4 are generally similar to those of the embodiment shown in FIGS. 1A to 3B.

Figure 5A:
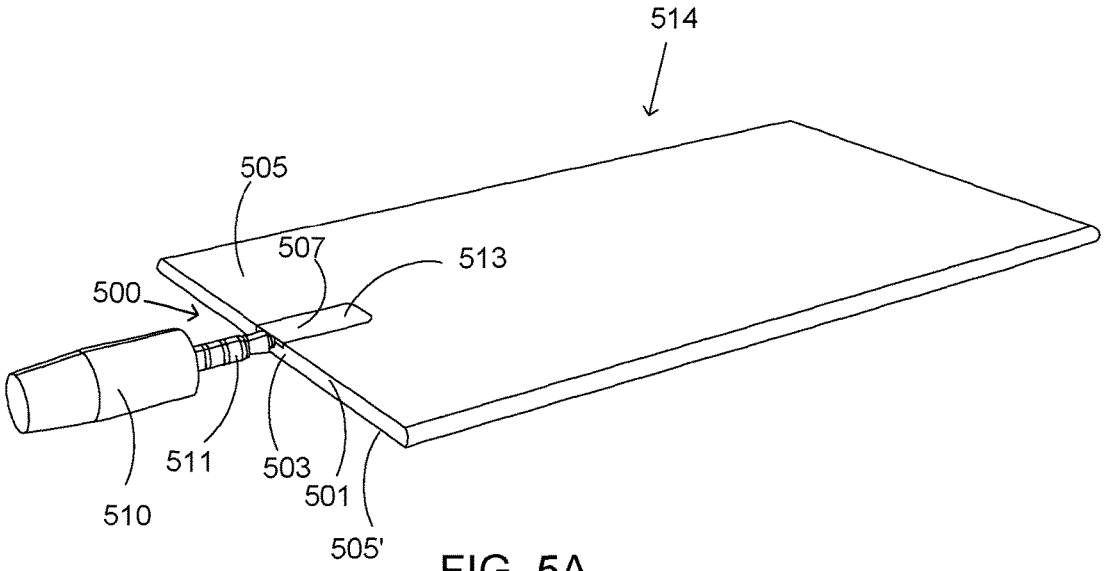
FIGS. 5A and 5B illustrate alternative perspective views and details of an embodiment of a plug receptacle and an electronic device.
Figure 5B:
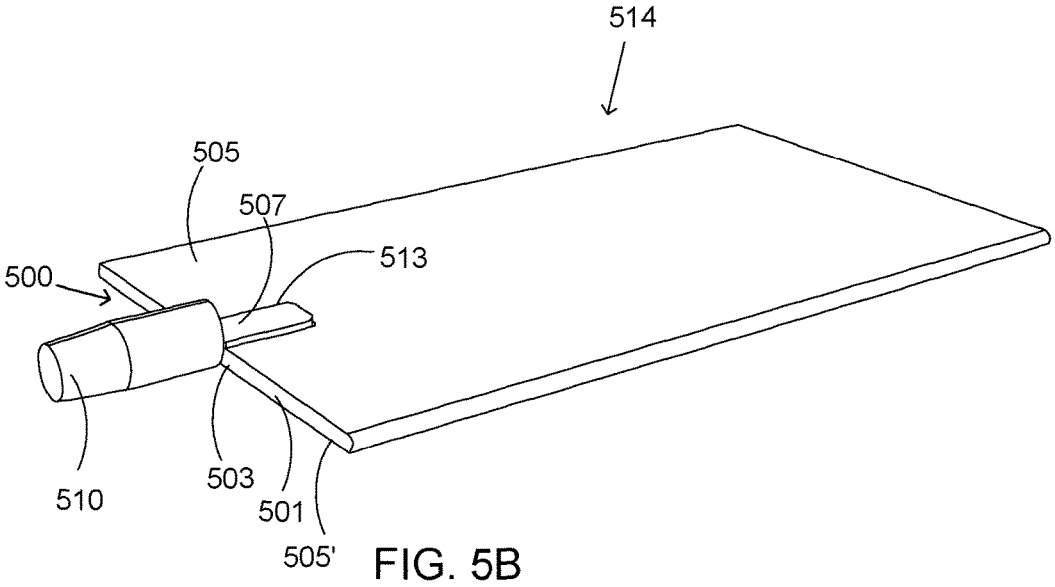

FIGS. 5A and 5B illustrate an embodiment of an electronic device 514. In an embodiment, the electronic device 514 comprises a plug receptacle 500 configured to receive at least a part of the plug 511 of a plug connector 510, in this embodiment a standard 2.5 mm or 3.5 mm audio connector. In an embodiment, the receptacle housing 501 is a part of the housing of the electronic device 514. In this embodiment, the electronic device 514, i.e. its housing, has a top side 505, and in the cover position illustrated in FIG. 5A, the top side 513 of the plug receptacle cover 507 is flush with the top side 505 of the electronic device 514. In an embodiment, the top side 513 of the plug receptacle cover 507 is recessed within the top side 505 of the receptacle housing 501. In an embodiment, it may protrude or slightly protrude from the top side 505 of the receptacle housing 501 in the cover position.

In the elevated position shown in FIG. 5B, the plug receptacle cover 507 or at least a part of the top side 513 thereof protrudes outwards from the top side 505 of the electronic device 514.

As illustrated in these FIGS., the electronic device 514 may be relatively thin, in particular when a plug 511 is not inserted. The thickness of the electronic device 514 may be e.g. up to 5.5 mm, or up to 4 mm, or up to 3 mm. In an embodiment, the electronic device 514 has a thickness that is smaller than a height or diameter of the at least the part of the plug 511 the housing is configured to receive. However, the electronic device 514 is not particularly limited to such thicknesses but may be thicker or thinner. Even in relatively thick electronic devices, the plug receptacle according to one or more embodiments described in this specification may save valuable space. The electronic device 514 may be, for instance, a tablet computer, a smartphone or a mobile phone, a phablet, a media player, a personal digital assistant, an e-book reader, a game console, a wearable device, a display or a flat-screen television. The electronic device 514 may comprise a touchscreen or another type of display. The touchscreen or other type of display may be disposed on the bottom side 505', not being visible in the FIGS., the top side 505 thus being the back side or a part of the back portion of the electronic device 514.

The electronic device 514 may comprise any plug receptacle described in this specification, such as the plug receptacles described in FIG. 2A, 2B or 4 comprising at least two plug receptacle covers, or any plug receptacle described in FIGS. 1A to 8.

In an embodiment, at least a part of the plug receptacle cover 507 is radio-frequency (RF) transparent. At least a part of such a plug receptacle cover 507 may be of a RF transparent material. Examples of such RF transparent materials may include any non-conductive material, such as rubber, silicone or plastic. In an electronic device 514 in which the cover or housing of the device, such as a unibody, is otherwise made of a metallic material or other material that is not RF transparent, such as aluminium, aluminium alloy, a magnesium alloy or other suitable metal, such a RF transparent part of the plug receptacle cover 507 may allow transmission of radio-frequency electromagnetic waves to and from the one or more antennas, antenna feeds or other RF components. One or more antennas, antenna feeds or other RF components may be disposed within the electronic device below or in proximity of the plug receptacle cover 507. The size and the dimensions of the plug receptacle cover 507 or the part thereof that is RF transparent may be selected so that is sufficient to allow the operation of the one or more antennas, antenna feeds or other RF components. This may help in saving space within the electronic device. This may also help in eliminating the so-called antenna lines, i.e. slots in a metal unibody which allow antenna operation.

Other aspects of the embodiment shown in FIGS. 5A and 5B are generally similar to those of the embodiments shown in FIGS. 3A to 4.

Figure 6A:
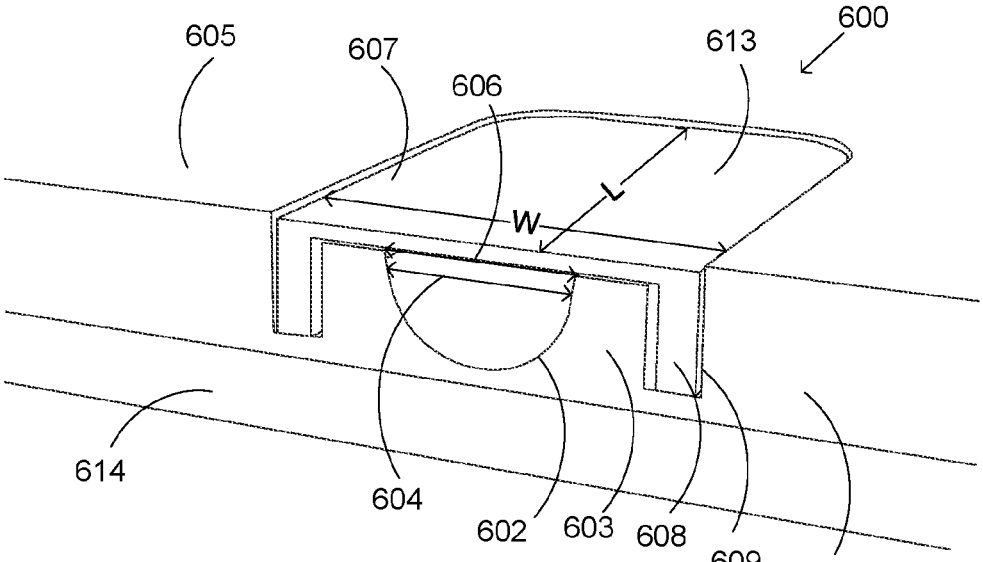
FIGS. 6A and 6B illustrate alternative perspective views and details of an embodiment of a plug receptacle and an electronic device.

FIG. 6A illustrates an embodiment of the plug receptacle 600 as a part of an electronic device 614. In this exemplary embodiment, the plug receptacle cover 607 is monolithic. It has a top side 613 and support portions 608. The receptacle housing 601 comprises guide structures 609 configured to guide the movement, e.g. sliding, of the plug receptacle cover 607 between the cover position and the elevated position. The support portions 608 are configured to move, e.g. slide, within and along the guide structures 609. In this exemplary embodiment, the guide structures 609 comprise recesses extending into the receptacle housing 601 and opening to the top side 605. The support portions 608 extend within or along the guide structures 609 and are configured to slide with respect to them. The guide structures 609 may comprise e.g. vertical indentations or protrusions or other slidable elements configured to engage complementary vertical protrusions or indentations in the support portions 608. The support portions 608 may be perpendicular to the top side 613 as in this exemplary embodiment, but various other configurations may be contemplated. The support portions 608 also connect the plug receptacle cover 607 to the receptacle housing 601. In FIG. 6A, the plug receptacle cover 607 is shown in the cover position.

Figure 6B:
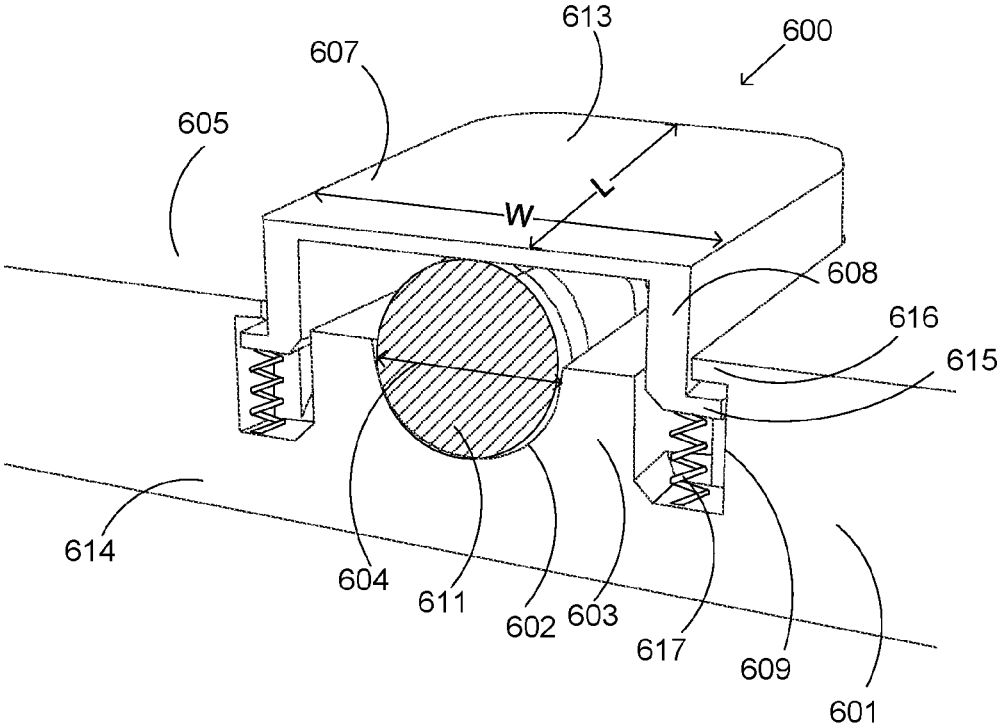

FIG. 6B illustrates another embodiment of the plug receptacle 600 as a part of an electronic device 614. The plug receptacle 600 of FIG. 6B differs from that of FIG. 6A at least in that the plug receptacle cover 607 is in the elevated position. In the elevated position, the plug receptacle cover 607 is elevated along its entire length L. It is also elevated outwards along its entire width W. Thus the entire plug receptacle cover 607 is elevated relative to the cover position. The at least the part of plug 611 inserted in the plug receptacle 600 is shown as a cross-section.

The plug receptacle 600 of FIG. 6B differs further from that of FIG. 6A at least in that the plug receptacle 600 comprises a stopper arrangement 615 configured to prevent the movement of the plug receptacle cover 607 past the elevated position. The stopper arrangement 615 is configured to prevent the movement of the plug receptacle cover 607 so far away from the longitudinal passage 602 that it is no longer connected to the plug receptacle 600. The stopper arrangement 615 may be integrated into the plug receptacle cover 607. In this exemplary embodiment, the stopper arrangement comprises flanges 615 extending laterally from the support portions 608. The receptacle housing 601 comprises complementary flanges 616 configured to engage the flanges 615 extending from the support portions 608, so that the plug receptacle cover 607 is prevented from moving past the elevated position in which the flanges 615 and 616 are in contact. Other stopper arrangements may also be contemplated.

In this embodiment, the plug receptacle 600 further comprises a returning arrangement 617. In this exemplary embodiment, the returning arrangement 617 is a spring element, for instance a helical spring, that is connected to and extends between the support portions 608 and the receptacle housing 601, in particular the guide structures 609. As the plug receptacle cover 607 moves outwards, the spring element is stretched, and it is thus configured to return back to its length in the cover position and thereby return the plug receptacle cover 607 back to the cover position. Such a returning arrangement 617 may also function as a stopper arrangement as may resist and restricts the movement of the plug receptacle cover 607. The returning arrangement 617 may, instead of a spring element, comprise another type of an elastic element or a magnetic arrangement. Such a magnetic arrangement may comprise, for example, a magnetically attractable element disposed in the plug receptacle cover 607 and a magnet in the receptacle housing 601, or vice versa. Other returning arrangements may also be contemplated.

Figure 7A:
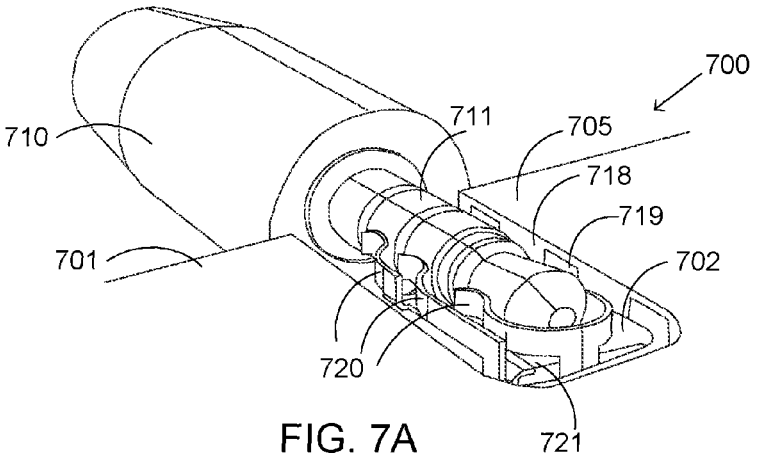
FIGS. 7A and 7B illustrate alternative perspective views and details of an embodiment of a plug receptacle.

The plug receptacle may comprise one or more electric contacts. The type and positions of the one or more electric contacts may depend on the type of plug the receptacle is configured to receive. The electronic device may further comprise a connecting circuitry with which the electric contacts are in contact. FIG. 7A illustrates an exemplary embodiment comprising electric contacts 720 that may be disposed in the receptacle housing 701 and within the longitudinal passage 702, which in this embodiment is a longitudinal groove. The longitudinal groove 702 has opposite side walls 718 that are perpendicular to the top side 705 of the receptacle housing 701. There is a plurality of openings 719 in the side walls 718 of the longitudinal groove 702 to which parts of the plug receptacle cover 707, for instance a plug receptacle cover 707 similar to that shown in FIG. 7B, may be arranged. The longitudinal groove 702 has a bottom 721 that may be essentially planar, arcuate or partially circular.

The plug receptacle 700 comprises a plurality of electric contacts 720 disposed at least partially within the longitudinal groove 702. The electric contacts 720 are configured to engage the at least the part of the plug 711 when the at least the part of the plug 711 is inserted. The electric contacts 730 are configured to contact the at least the part of the plug 711 from the lateral direction. They are thus arranged between the at least the part of the plug 711 and the side walls 718. The lateral direction may be generally parallel to the top side 705 of the receptacle housing 701. The lateral direction may be generally parallel to the width of the plug receptacle cover and perpendicular to the length (longitudinal axis) of the at least the part of the plug 711 the plug receptacle 700 is configured to receive. In this embodiment, the plug receptacle 700 comprises an electric contact arrangement comprising a plurality of electric contacts 720 configured to engage at least a part of the plug of a standard 2.5 mm or 3.5 mm audio connector. The electric contacts 720 may be formed, for example, of sheet metal or metal wire.

Figure 7B:
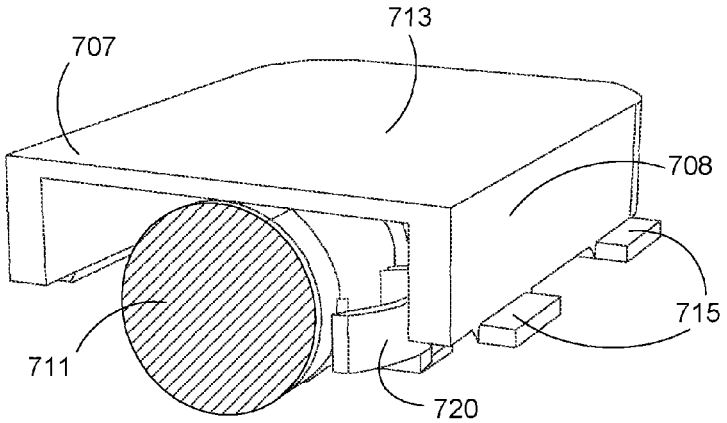

FIG. 7B illustrates an embodiment of the plug receptacle cover 707. The plug receptacle cover 707 comprises support portions 708 and flanges 715 extending from the support portions 708 in the lateral direction. The flanges 715 may be arranged in the openings 719 in the side walls 718 of the longitudinal groove shown in FIG. 7A. The flanges 715 may thus function as a part of a stopper arrangement in the same manner as the flanges 615 shown in FIG. 6B.

In the embodiment shown in FIG. 7B, the plug receptacle cover 707 is shown in contact with the at least the part of the plug 711. The electric contacts 720 are disposed between the support portion 708 and the at least the part of the plug 711.

Figure 8:
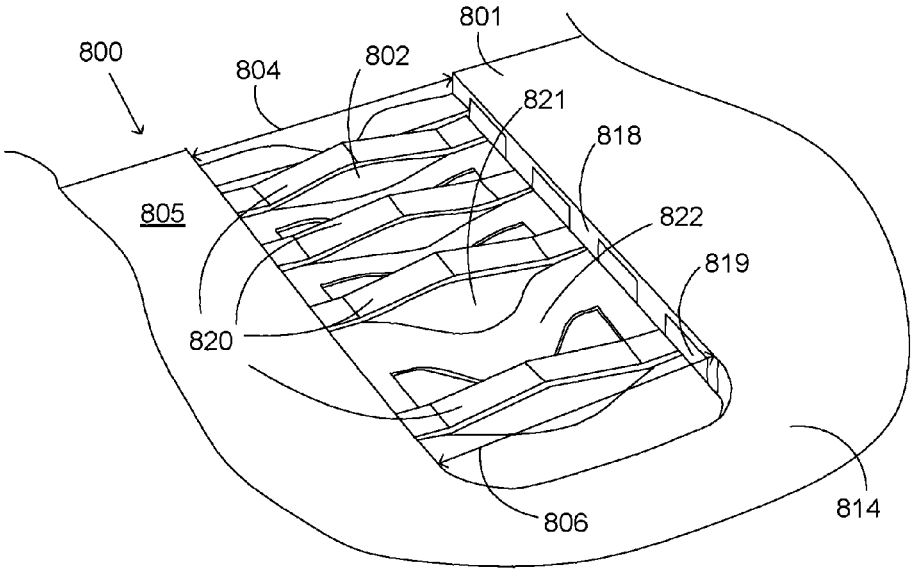
FIG. 8 illustrates a perspective view of an embodiment of a plug receptacle.

FIG. 8 illustrates a perspective view of an exemplary embodiment of a plug receptacle 800 as a part of an electronic device 814. The receptacle housing 801 has a longitudinal passage, in this embodiment a longitudinal groove 802, a first opening 804 and a second opening 806, which openings intersect. The longitudinal groove 802 has opposite side walls 818 that are perpendicular to the top side 805 of the receptacle housing 801. There is a plurality of openings 819 in the side walls 818 of the longitudinal groove 802 to which the plug receptacle cover, not shown in FIG. 8, may be attached.

The longitudinal groove 802 has a bottom 821 that may be essentially flat or planar, arcuate or partially circular. In this embodiment, a planar metal plate forms the bottom 821. The plug receptacle 800 comprises a plurality of electric contacts 820. The electric contacts 820 are configured to engage the at least the part of the plug (not shown in FIG. 8) when it is inserted. In this embodiment, the plug receptacle 800 comprises an electric contact arrangement including four electric contacts 820 configured to engage at least a part of the plug, such as the plug of a standard 2.5 mm or 3.5 mm audio connector. The electric contacts 820 are spaced apart along the length of the longitudinal groove 802. Each of the electric contacts 820 is a flat spring. Each of the electric contacts 820 is thus configured to function as a spring which presses towards or against a contact surface of the at least the part of the plug. The electric contacts 820 are disposed transversely with respect to the length of the longitudinal groove 802. The length of the longitudinal groove 802 is parallel to the length (longitudinal axis) of the at least the part of the plug it is configured to receive. The electric contacts 820 extend between the opposite side walls 818 of the longitudinal groove 802 and may extend wall to wall. However, other shapes and configurations of electric contacts 820 may also be contemplated. In this exemplary embodiment, the electric contacts 820 are disposed between the bottom 820 of the longitudinal groove 802 and the plug receptacle cover, so that they are configured to be in contact with and thus engage the at least the part of the plug and bend towards the bottom 821 of the longitudinal groove 802 when the at least the part of the plug is received in the plug receptacle 800. With the electric contact arrangement shown in FIG. 8, the thickness of the electric contact arrangement may be very small, e.g. approximately 0.3 mm when in use the electric contacts 820 are compressed towards the bottom 821 of the longitudinal groove 802.

A flex portion 822 is disposed below the electric contacts 820, i.e. between the electric contacts 820 and the bottom 821 of the longitudinal groove 802. The flex portion 822 may insulate the electric contacts 820 from the bottom 821 of the longitudinal groove. The flex portion 822 may be elastic, so that when in use, electric contacts 820 bending towards the bottom 821 of the longitudinal groove 802 may be in contact with the flex portion 822 without damaging it.

In this exemplary embodiment, the plug receptacle 800 may be particularly thin. For example, for a standard 2.5 mm or 3.5 mm audio connector, the thickness (height) of the entire plug receptacle 800 from the bottom side of the receptacle housing 801 to the top side 813 of the plug receptacle cover in the cover position may be smaller than 2 mm, for example approximately 1.3 mm. For comparison, the thickness (height) of a standard 3.5 mm audio connector receptacle may be approximately 4 mm. In such an example, the flex portion 822 may be approximately 0.15 mm thick, the electric contacts 820 approximately 0.15 mm thick, the plug receptacle cover 807 may be approximately 0.7-1 mm thick and the bottom 821 of the longitudinal groove 802 may be approximately 0.3 mm thick. However, various other sizes for individual components and the plug receptacle 800 may be contemplated.

Some embodiments are further discussed shortly in the following.

In a first aspect, a plug receptacle may comprise a receptacle housing having a passage configured to receive at least a part of a plug of a plug connector, a front side having a first opening and a top side having a second, elongated opening that intersects the first opening, the passage opening to the front side via the first opening and to the top side via the second opening; and at least one plug receptacle cover that is configured to move between a cover position and an elevated position, wherein in the cover position, the at least one plug receptacle cover covers the second opening at least partially; and in the elevated position, the at least one plug receptacle cover is elevated outwards, the plug receptacle thereby being configured to receive the at least the part of the plug so that the at least the part of the plug partially extends through the second opening.

In an embodiment which may be in accordance with the preceding embodiment, the passage is longitudinal.

In an embodiment which may be in accordance with any of the preceding embodiments, in the elevated position, the plug receptacle cover is elevated outwards along its entire length.

In an embodiment which may be in accordance with any of the preceding embodiments, in the elevated position, the at least one plug receptacle cover is elevated outwards along its entire width.

In an embodiment which may be in accordance with any of the preceding embodiments, the receptacle housing comprises a guide structure configured to guide the movement of the at least one plug receptacle cover between the cover position and the elevated position.

In an embodiment which may be in accordance with any of the preceding embodiments, the at least one plug receptacle cover has a top side, and in the cover position, the top side of the at least one plug receptacle cover is flush with the top side of the receptacle housing.

In an embodiment which may be in accordance with any of the preceding embodiments, the plug receptacle comprises a stopper arrangement configured to prevent the movement of the at least one plug receptacle cover past the elevated position.

In an embodiment which may be in accordance with any of the preceding embodiments, the plug receptacle comprises a returning arrangement configured to return the at least one plug receptacle cover to the cover position upon removal of the at least the part of the plug.

In an embodiment which may be in accordance with any of the preceding embodiments, the at least one plug receptacle cover is configured to exert a force against the at least the part of the plug in the elevated position, thereby engaging the at least the part of the plug.

In an embodiment which may be in accordance with any of the preceding embodiments, the plug receptacle is an audio plug receptacle configured to receive at least a part of the plug of an audio plug connector.

In an embodiment which may be in accordance with any of the preceding embodiments, the plug receptacle is an audio plug receptacle configured to receive at least a part of the plug of a standard 2.5 mm or 3.5 mm audio plug connector.

In an embodiment which may be in accordance with any of the preceding embodiments, in the cover position, the passage and the at least one plug receptacle cover define a space having a height smaller than a height of the at least the part of the plug.

In an embodiment which may be in accordance with any of the preceding embodiments, the receptacle housing has a height that is smaller than a height of the at least the part of the plug.

In an embodiment which may be in accordance with any of the preceding embodiments, the receptacle housing has a bottom side having a third, elongated opening that intersects the first opening, the passage opening to the bottom side via the third opening; and the plug receptacle comprises a first plug receptacle cover at the top side of the receptacle housing and a second plug receptacle cover at the bottom side of the receptacle housing, the first and second plug receptacle cover being configured to move between a cover position and an elevated position, wherein in the cover position, the first plug receptacle cover covers the second opening at least partially and the second plug receptacle cover covers the third opening at least partially; and in the elevated position, the first and second plug receptacle covers are elevated outwards along their entire lengths, the plug receptacle thereby being configured to receive the at least the part of the plug between the first and second receptacle cover so that the at least the part of the plug partially extends through the second and third opening.

In an embodiment which may be in accordance with any of the preceding embodiments, the first, second and third openings intersect to form a continuous opening via which the passage opens to the front side, top side and bottom side.

In an embodiment which may be in accordance with any of the preceding embodiments, the plug receptacle comprises a receptacle housing having a passage or longitudinal groove configured to receive at least a part of a plug of an audio plug connector, a front side having a first opening and a top side having a second, elongated opening that intersects the first opening, the passage or longitudinal groove opening to the front side via the first opening and to the top side via the second opening; and at least one plug receptacle cover that is configured to move between a cover position and an elevated position, wherein in the cover position, the at least one plug receptacle cover covers the second opening at least partially; and in the elevated position, the at least one plug receptacle cover is elevated outwards, the plug receptacle thereby being configured to receive the at least the part of the plug so that the plug partially extends through the second opening.

In an embodiment which may be in accordance with any of the preceding embodiments, the plug receptacle comprises a plurality of electric contacts that are configured to contact the at least the part of the plug from the lateral direction.

In an embodiment which may be in accordance with any of the preceding embodiments, the plug receptacle comprises a plurality of electric contacts spaced apart along a length of the longitudinal groove between a bottom of the longitudinal groove and the at least one plug receptacle cover, the electric contacts being flat springs configured to engage the at least the part of the plug and bend towards the bottom of the longitudinal groove when the at least the part of the plug is received in the plug receptacle.

In an embodiment which may be in accordance with any of the preceding embodiments, the electric contacts are disposed transversely with respect to the length of the longitudinal groove.

In an embodiment which may be in accordance with any of the preceding embodiments, in the cover position, the longitudinal groove and the plug receptacle cover define a space having a height smaller than a height of the at least the part of the plug.

In a second aspect, an electronic device may comprise a plug receptacle according to any one of the preceding embodiments.

In a third aspect, an electronic device may comprise a housing having a passage configured to receive at least a part of a plug of a plug connector, a front side having a first opening and a top side having a second, elongated opening that intersects the first opening, the passage opening to the front side via the first opening and to the top side via the second opening; and at least one plug receptacle cover that is configured to move between a cover position and an elevated position, wherein in the cover position, the at least one plug receptacle cover covers the second opening at least partially, and in the elevated position, the at least one plug receptacle cover is elevated outwards, the electronic device thereby being configured to receive the at least the part of the plug so that the at least the part of the plug partially extends through the second opening.

In an embodiment which may be in accordance with the preceding embodiment, the passage is longitudinal.

In an embodiment which may be in accordance with any of the preceding embodiments, in the elevated position, the at least one plug receptacle cover is elevated outwards along its entire length.

In an embodiment which may be in accordance with any of the preceding embodiments, in the elevated position, the at least one plug receptacle cover is elevated outwards along its entire width.

In an embodiment which may be in accordance with any of the preceding embodiments, the housing comprises a guide structure configured to guide the movement of the at least one plug receptacle cover between the cover position and the elevated position.

In an embodiment which may be in accordance with any of the preceding embodiments, the electronic device comprises a stopper arrangement configured to prevent the movement of the at least one plug receptacle cover past the elevated position.

In an embodiment which may be in accordance with any of the preceding embodiments, the electronic device comprises a returning arrangement configured to return the at least one plug receptacle cover to the cover position upon removal of the at least the part of the plug.

In an embodiment which may be in accordance with any of the preceding embodiments, the at least one plug receptacle cover is configured to exert a force against the at least the part of the plug in the elevated position, thereby engaging the at least the part of the plug.

In an embodiment which may be in accordance with any of the preceding embodiments, the electronic device is configured to receive at least a part of the plug of an audio plug connector.

In an embodiment which may be in accordance with any of the preceding embodiments, the electronic device is configured to receive at least a part of the plug of a standard 2.5 mm or 3.5 mm audio plug connector.

In an embodiment which may be in accordance with any of the preceding embodiments, in the cover position, the passage and the at least one plug receptacle cover define a space having a height smaller than a height of the at least the part of the plug.

In an embodiment which may be in accordance with any of the preceding embodiments, the housing has a height that is smaller than a height of the at least the part of the plug.

In an embodiment which may be in accordance with any of the preceding embodiments, the housing has a bottom side having a third, elongated opening that intersects the first opening, the passage opening to the bottom side via the third opening; and the electronic device comprises a first plug receptacle cover at the top side of the housing and a second plug receptacle cover at the bottom side of the housing, the first and second plug receptacle cover being configured to move between a cover position and an elevated position, wherein in the cover position, the first plug receptacle cover covers the second opening at least partially and the second plug receptacle cover covers the third opening at least partially; and in the elevated position, the first and second plug receptacle covers are elevated outwards along their entire lengths, the electronic device thereby being configured to receive the at least the part of the plug between the first and second receptacle cover so that the at least the part of the plug partially extends through the second and third opening.

In an embodiment which may be in accordance with any of the preceding embodiments, the first, second and third openings intersect to form a continuous opening via which the passage opens to the front side, top side and bottom side.

In an embodiment which may be in accordance with any of the preceding embodiments, the electronic device comprises a housing having a passage or groove configured to receive at least a part of a plug of an audio plug connector, a front side having a first opening and a top side having a second, elongated opening that intersects the first opening, the passage or groove opening to the front side via the first opening and to the top side via the second opening; and at least one plug receptacle cover that is configured to move between a cover position and an elevated position, wherein in the cover position, the at least one plug receptacle cover covers the second opening at least partially; and in the elevated position, the at least one plug receptacle cover is elevated outwards, the electronic device thereby being configured to receive the at least the part of the plug so that the plug partially extends through the second opening.

In an embodiment which may be in accordance with any of the preceding embodiments, the electronic device comprises a plurality of electric contacts that are configured to contact the at least the part of the plug from the lateral direction.

In an embodiment which may be in accordance with any of the preceding embodiments, the passage is a longitudinal groove.

In an embodiment which may be in accordance with any of the preceding embodiments, the electronic device comprises a plurality of electric contacts spaced apart along a length of the longitudinal groove between a bottom of the longitudinal groove and the at least one plug receptacle cover, the electric contacts being flat springs configured to engage the at least the part of the plug and bend towards the bottom of the longitudinal groove when the at least the part of the plug is received in the plug receptacle.

In an embodiment which may be in accordance with any of the preceding embodiments, the electric contacts are disposed transversely with respect to the length of the longitudinal groove.

In an embodiment which may be in accordance with any of the preceding embodiments, in the cover position, the longitudinal groove and the plug receptacle cover define a space having a height smaller than a height of the at least the part of the plug.

In an embodiment which may be in accordance with any of the preceding embodiments, the at least one plug receptacle cover has a top side and the housing has a top side, and in the cover position, the top side of the at least one plug receptacle cover is flush with the top side of the housing.

In an embodiment which may be in accordance with any of the preceding embodiments, at least a part of the at least one plug receptacle cover is radio-frequency transparent.

Although some of the present embodiments may be described and illustrated as being implemented in a smartphone, a mobile phone, or a tablet computer, these are only examples of a device and not a limitation. As those skilled in the art will appreciate, the present embodiments are suitable for application in a variety of different types of devices, such as portable and mobile devices, for example, in laptop computers, tablet computers, game consoles or game controllers, various wearable devices, etc.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The embodiments illustrated and described herein as well as embodiments not specifically described herein but within the scope of aspects of the claims constitute exemplary means for receiving at least a part of a plug of a plug connector. The receptacles 100, 200, 300, 400, 600, 700, 800, receptacle housings 101, 201, 301, 401, 501, 601, 701, 801 and passages 102, 202, 302, 602, 702, 802 constitute exemplary receiving means for receiving at least a part of a plug of a plug connector. The plug receptacle covers 107, 207, 307, 407, 507, 607, 707 constitute exemplary moving means for covering the plug receptacle and optionally for engaging the at least a part of the plug. The guide structures 109, 209, 609 illustrate exemplary guiding means for guiding the movement of the plug receptacle cover. The stopper arrangements 615, 715 constitute exemplary stopping means for preventing the movement of the at least one plug receptacle cover past the elevated position. The returning arrangement 617 constitutes exemplary returning means for returning the at least one plug receptacle cover to the cover position upon removal of the at least the part of the plug. The electric contacts 720, 820 illustrate exemplary electric contacting means for electrically engaging the at least the part of the plug.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The term "comprising" is used in this specification to mean including the feature(s) or act(s) followed thereafter, without excluding the presence of one or more additional features or acts.

The invention claimed is:

1. A plug receptacle, comprising:

a receptacle housing having a passage configured to receive at least a part of a plug of a plug connector, a front side having a first opening, a top side having a second elongated opening that intersects the first opening, and a bottom side having a third elongated opening that intersects the first opening, the passage opening to the front side via the first opening, to the top side via the second opening, and to the bottom side via the third opening;

a first plug receptacle cover configured to move between a cover position and an elevated position; and a second plug receptacle cover configured to move between a cover position and an elevated position;

wherein, in the cover position, the first plug receptacle cover covers the second opening and the second plug receptacle cover covers the third opening; and in the elevated position, the first and second plug receptacle covers are elevated outwards along their entire lengths, the plug receptacle thereby being configured to receive the at least the part of the plug between the first and second receptacle covers so that the at least the part of the plug partially extends through the second and third openings.

2. A plug receptacle as defined in claim 1, wherein in the elevated position, the first and second plug receptacle covers are elevated outwards along their entire widths.

3. A plug receptacle as defined in claim 1, wherein the receptacle housing comprises a guide structure configured to guide the movement of at least one of the first plug receptacle cover or the second plug receptacle cover between the cover position and the elevated position.

4. A plug receptacle as defined in claim 1, wherein the first plug receptacle cover has a top side, and in the cover position, the top side of the first plug receptacle cover is flush with the top side of the receptacle housing.

5. A plug receptacle as defined in claim 1, wherein the plug receptacle comprises a stopper arrangement configured to prevent the movement of at least one of the first plug receptacle cover or the second plug receptacle cover past the elevated position.

6. A plug receptacle as defined in claim 1, wherein the plug receptacle comprises a returning arrangement configured to return at least one of the first plug receptacle cover or the second plug receptacle cover to the cover position upon removal of the at least the part of the plug.

7. A plug receptacle as defined in claim 1, wherein at least one of the first plug receptacle cover or the second plug receptacle cover is configured to exert a force against the at least the part of the plug in the elevated position, thereby engaging the at least the part of the plug.

8. A plug receptacle as defined in claim 1, wherein the plug receptacle is an audio plug receptacle configured to receive at least a part of the plug of a standard 2.5 mm or 3.5 mm audio plug connector.

9. A plug receptacle as defined in claim 1, wherein in the cover position, the passage and the first and second plug receptacle covers define a space having a height smaller than a height of the at least the part of the plug.

10. A plug receptacle as defined in claim 1, wherein the receptacle housing has a height that is smaller than a height of the at least the part of the plug.

11. A plug receptacle as defined in claim 1, wherein the first, second and third openings intersect to form a continuous opening via which the passage opens to the front side, top side and bottom side.

12. An electric plug receptacle, comprising:

a receptacle housing having a longitudinal groove configured to receive at least a part of a plug of an audio plug connector, a front side having a first opening, a top side having a second elongated opening that intersects the first opening, and a bottom side having a third elongated opening that intersects the first opening, the longitudinal groove opening to the front side via the first opening, to the top side via the second opening, and to the bottom side via the third opening;

a first plug receptacle cover configured to move between a cover position and an elevated position; and a second plug receptacle cover configured to move between a cover position and an elevated position;

wherein in the cover position, the first plug receptacle cover covers the second opening and the second plug receptacle cover covers the third opening; and in the elevated position, the first and second plug receptacle covers are elevated outwards, the plug receptacle thereby being configured to receive the at least the part of the plug so that the plug partially extends through the second and third openings.

13. An electric plug receptacle as defined in claim 12, wherein the plug receptacle comprises a plurality of electric contacts that are configured to contact the at least the part of the plug from the lateral direction.

14. An electric plug receptacle as defined in claim 12, wherein in the cover position, the longitudinal groove and the first and second plug receptacle covers define a space having a height smaller than a height of the at least the part of the plug.

15. An electric plug receptacle as defined in claim 12, wherein the plug receptacle comprises a plurality of electric contacts spaced apart along a length of the longitudinal groove between the first and second plug receptacle covers, the electric contacts being flat springs configured to engage the at least the part of the plug and bend towards the bottom of the longitudinal groove when the at least the part of the plug is received in the plug receptacle.

16. An electric plug receptacle as defined in claim 15, wherein the electric contacts are disposed transversely with respect to the length of the longitudinal groove.

17. An electronic device, comprising:

a housing having a passage configured to receive at least a part of a plug of a plug connector, a front side having a first opening, a top side having a second elongated opening that intersects the first opening, and a bottom side having a third elongated opening that intersects the first opening, the passage opening to the front side via the first opening, to the top side via the second opening, and to the bottom side via the third opening;

a first plug receptacle cover configured to move between a cover position and an elevated position; and a second plug receptacle cover configured to move between a cover position and an elevated position;

wherein in the cover position, the first plug receptacle cover covers the second opening and the second plug receptacle cover covers the third opening, and in the elevated position, the first and second plug receptacle covers are elevated outwards along their entire lengths, the electronic device thereby being configured to receive the at least the part of the plug between the first and second plug receptacle covers so that the at least the part of the plug partially extends through the second and third openings.

18. An electronic device as defined in claim 17, wherein the first plug receptacle cover has a top side, and in the cover position, the top side of the first plug receptacle cover is flush with the top side of the housing.

19. An electronic device as defined in claim 17, wherein at least a part of the first plug receptacle cover is radio-frequency transparent.

20. An electronic device as defined in claim 17, wherein the electronic device has an audio plug receptacle configured to receive at least a part of the plug of a standard 2.5 mm or 3.5 mm audio plug connector.

* * * * *